US010777946B2

(12) United States Patent
Chu

(10) Patent No.: US 10,777,946 B2
(45) Date of Patent: Sep. 15, 2020

(54) TEMPERATURE CONTROL POWER CORD, POWER CORD WITH POWER-OFF INDICATION, AND POWER CORD CONNECTED WITH LOAD POWER SOURCE

(71) Applicant: Hak Kee Chu, Dongguan (CN)

(72) Inventor: Hak Kee Chu, Dongguan (CN)

( * ) Notice: Subject to any disclaimer, the term of this patent is extended or adjusted under 35 U.S.C. 154(b) by 0 days.

(21) Appl. No.: 16/251,341

(22) Filed: Jan. 18, 2019

(65) Prior Publication Data

US 2020/0044397 A1 Feb. 6, 2020

(51) Int. Cl.
*H01R 13/713* (2006.01)
*H01R 24/30* (2011.01)
*H01R 13/717* (2006.01)

(52) U.S. Cl.
CPC ..... *H01R 13/713* (2013.01); *H01R 13/717* (2013.01); *H01R 24/30* (2013.01)

(58) Field of Classification Search
CPC ..... H01R 13/665; H01R 13/6666; H01R 13/6683; H01R 13/6691; H01R 13/70; H01R 13/713; H01R 13/7137; H01R 13/717; H01R 24/30
See application file for complete search history.

(56) References Cited

U.S. PATENT DOCUMENTS 4,118,690 A * 10/1978 Paynton ..... H01R 13/717 324/508
5,418,521 A * 5/1995 Read ..... G08B 13/1409 200/61.59
6,290,533 B1 * 9/2001 Major ..... H01R 13/652 362/253
8,729,856 B2 * 5/2014 Nathan ..... H01R 13/6683 320/109
8,866,485 B1 * 10/2014 Lacey ..... H01R 25/003 324/508
9,716,352 B1 * 7/2017 Gilliland ..... H01R 24/30
2005/0124209 A1 * 6/2005 Currie ..... H01R 13/7172 439/490
2007/0139177 A1 * 6/2007 Fleury ..... B60D 1/60 340/438
2011/0141635 A1 * 6/2011 Fabian ..... H01H 83/22 361/45
2014/0302717 A1 * 10/2014 Cheng ..... H01R 13/7137 439/620.21

(Continued)

*Primary Examiner* — Oscar C Jimenez
(74) *Attorney, Agent, or Firm* — Southeast IP Group, LLC; Thomas L. Moses

(57) ABSTRACT

A temperature control power cord, a power cord with power-off indication, and a power cord connected with a load power source, comprising a shell, a power output cord, a null wire pin that is arranged on one side of the shell, and is electrically connected with the power output cord, a live wire pin and a ground wire pin, wherein a temperature control switch is connected to the live wire pin in series; the present invention can monitor the temperature in the power plug; when the temperature in the plug is exorbitant, the electric connection between the power cord and the power-consuming equipment can be cut-off, thereby preventing the power cord from overheating, and warning the user that the power cord is in an off state.

9 Claims, 3 Drawing Sheets

(56) References Cited

U.S. PATENT DOCUMENTS

| | | | | |
|---|---|---|---|---|
| 2014/0313042 | A1* | 10/2014 | Scherer | H01R 13/641<br>340/660 |
| 2015/0362985 | A1* | 12/2015 | Thompson | G06F 1/3215<br>713/323 |
| 2016/0056588 | A1* | 2/2016 | Motoichi | H01R 13/7137<br>439/620.22 |
| 2016/0141812 | A1* | 5/2016 | Li | H01R 24/78<br>439/620.21 |
| 2017/0141519 | A1* | 5/2017 | Lu | H01R 13/6666 |
| 2018/0026407 | A1* | 1/2018 | Gilliland | H01R 13/641<br>439/103 |
| 2019/0168626 | A1* | 6/2019 | Spesser | B60L 53/16 |

* cited by examiner

TEMPERATURE CONTROL POWER CORD, POWER CORD WITH POWER-OFF INDICATION, AND POWER CORD CONNECTED WITH LOAD POWER SOURCE

TECHNICAL FIELD OF THE INVENTION

The present invention relates to the technical field of power cords, and more particularly, to a temperature control power cord, a power cord with power-off indication, and a power cord connected with a load power source.

BACKGROUND OF THE INVENTION

Power cords are widely used in every aspect of people's daily life. In order to prevent the power cord from overheating or even burning due to a short circuit or overload, most of the power plugs are internally provided with a temperature controller. When the temperature of the power plug is exorbitant, the temperature controller exerts control by switching-off the power-consuming equipment, thereby avoiding causing a fire due to the constant temperature rise of the power cord. In the prior art, the traditional power cord with a temperature controller fails to alarm a user when the power supply is cut-off at a high temperature. As a result, the power disconnection between the power-consuming equipment and the power cord cannot be detected timely, and the failure reason cannot be found quickly, severely affecting the normal operation of the power-consuming equipment.

SUMMARY OF THE INVENTION

The purpose of the present invention is to solve the shortcomings in the prior art by providing a temperature control power cord, a power cord with power-off indication, and a power cord connected with a load power source. The present invention has a unique structural design, and can monitor the temperature in the power plug. When the temperature in the plug is exorbitant, the electric connection between the power cord and the power-consuming equipment can be cut-off, thereby preventing the power cord from overheating, and warning the user that the power cord is in an off state.

To achieve the above purpose, the present invention adopts the following technical solution:

A temperature control power cord with a normally-on indicator light comprising a shell, a power output cord, a null wire pin that is arranged on one side of the shell, and is electrically connected with the power output cord, a live wire pin and a ground wire pin, wherein a temperature control switch is connected to the live wire pin in series, and an indicator light is connected between the live wire pin and the null wire pin in parallel.

In another preferred embodiment, the reset temperature of the temperature control switch 6 is 63±5° C.

In another preferred embodiment, the action temperature of the temperature control switch 6 is 78±3° C.

A temperature control power cord with a power-off indication circuit comprising a shell, a power output cord, a null wire pin that is arranged on one side of the shell, and is electrically connected with the power output cord, a live wire pin and a ground wire pin, wherein a temperature control switch is connected to the live wire pin in series, and a power-off indication control circuit board is connected between the live wire pin and the null wire pin in parallel, wherein a diode rectification filter module is arranged on the power-off indication control circuit board, and an indicator light that is electrically connected with the diode rectification filter module is arranged on the power-off indication control circuit board.

In another preferred embodiment, the reset temperature of the temperature control switch 6 is 63±5° C.

In another preferred embodiment, the action temperature of the temperature control switch 6 is 78±3° C.

A temperature control power cord connected with a load power source comprising a shell, a power output cord, a null wire pin that is arranged on one side of the shell, and is electrically connected with the power output cord, a live wire pin and a ground wire pin, wherein a temperature control switch is connected to the live wire pin in series, and the output end of the power output cord is electrically connected with a load power source, wherein the load power source comprises a power input end, and a power-off alarm circuit that is connected with the power input end in parallel, wherein the power-off alarm circuit is electrically connected with a battery that is arranged on the load power source, and a buzzer is arranged on the power-off alarm circuit.

In another preferred embodiment, the reset temperature of the temperature control switch 6 is 63±5° C.

In another preferred embodiment, the action temperature of the temperature control switch 6 is 78±3° C.

Compared with the prior art, the present invention has the following advantages:

The present invention discloses a temperature control power cord, a power cord with power-off indication, and a power cord connected with a load power source. The present invention has a unique structure, and can monitor the temperature in the power plug. When the temperature in the plug is exorbitant, the electric connection between the power cord and the power-consuming equipment can be cut-off, thereby preventing the power cord from overheating, and warning the user that the power cord is in an off state.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

Shell 1, Power Output Cord 2, Null Wire Pin 3, Live Wire Pin 4, Ground Wire Pin 5, Temperature Control Switch 6, Indicator Light 7, Power-off Indication Control Circuit Board 8, Load Power Source 9, Power Input End 90, Power-off Alarm Circuit 10, Battery 11, Buzzer 12

DETAILED DESCRIPTION OF THE INVENTION

Drawings and detailed embodiments are combined hereinafter to elaborate the technical principles of the present invention.

Figure 1:
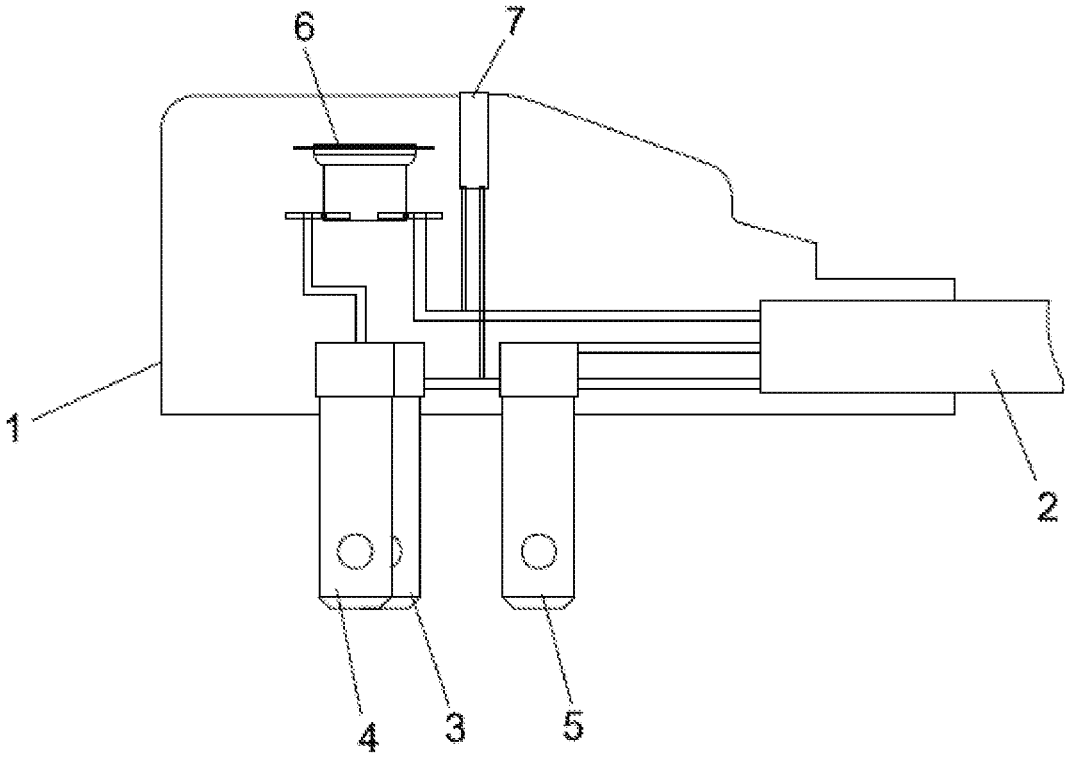
FIG. 1 is a sectional view of the temperature control power cord with a normally-on indicator light of the present invention.
Figure 2:
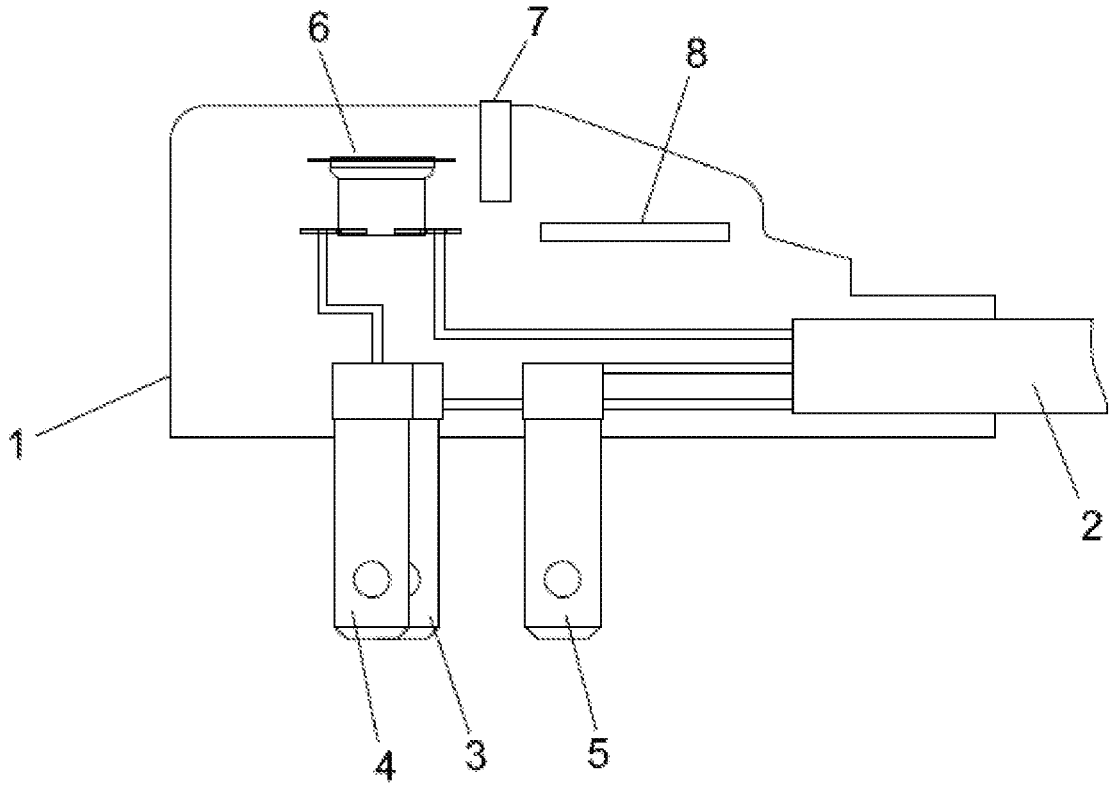
FIG. 2 is a sectional view of the temperature control power cord with a power-off indication circuit of the present invention.
Figure 3:
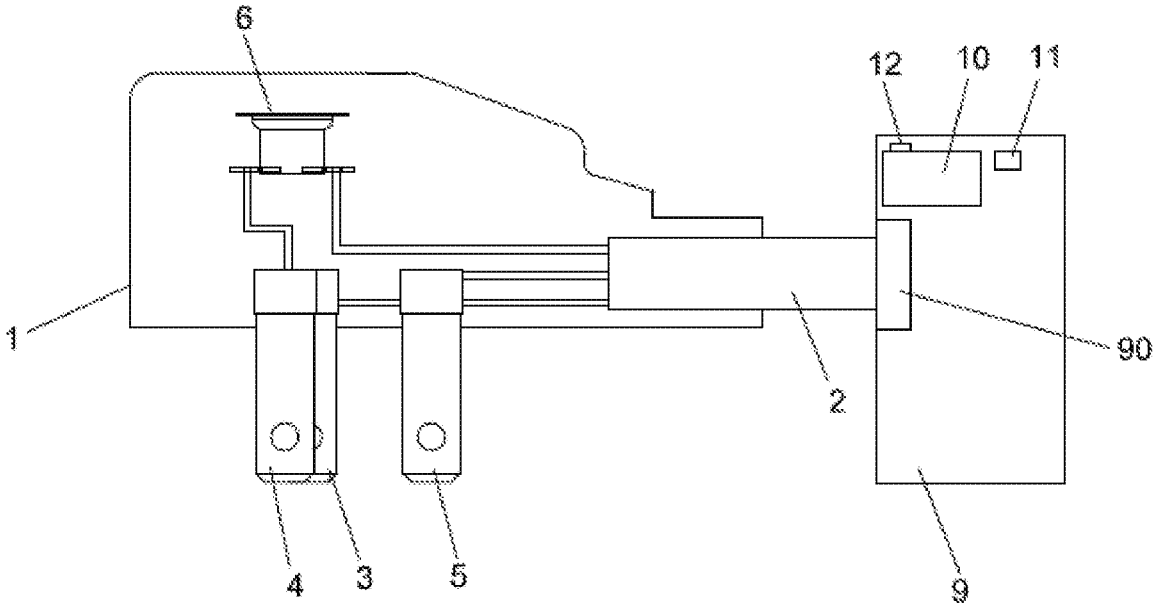
FIG. 3 is a sectional view of the temperature control power cord connected with a load power source of the present invention.

As shown in FIGS. 1-3, the present invention discloses a temperature control power cord with a normally-on indicator light. In this embodiment, the temperature control power cord with a normally-on indicator light comprises a shell 1, a power output cord 2, a null wire pin 3 that is arranged on one side of the shell 1, and is electrically connected with the power output cord 2, a live wire pin 4 and a ground wire pin 5, wherein a temperature control switch 6 is connected to the live wire pin 4 in series, and an indicator light 7 is connected between the live wire pin 4 and the null wire pin 3 in parallel.

The operating principle of the temperature control power cord with a normally-on indicator light is the following:

The power cord is electrically connected with a power-consuming equipment. The temperature control switch 6 can monitor the temperature in the shell 1, thereby exerting control by switching on/off the power-consuming equipment. When the temperature in the shell 1 is lower than the action temperature of the temperature control switch 6, the temperature control switch 6 is switched-on, and the electric connection between the live wire pin 4 and the power output cord 2 is achieved. Thus, the power cord normally supplies power to the power-consuming equipment, and the indicator light 7 is turned on, showing that the power cord is in a normal operating state. When excessive current is caused by the poor contact or overload of the plug, the temperature in the shell 1 can reach the action temperature of the temperature control switch 6. At this point, the temperature control switch 6 is automatically switched-off, the live wire pin 4 and the power output cord 2 are disconnected, the power cord stops supplying power to the power-consuming equipment, and the indicator light 7 is turned off. It means that the power cord is in a power-off state once the indicator light 7 is turned off, reminding the user to check the electric connection between the power cord and the power-consuming equipment in time. When the temperature in the shell 1 is decreased lower than the reset temperature of the temperature control switch 6, the temperature control switch 6 is switch-on again, and the power cord starts to supply power to the power-consuming equipment. At the moment, the indicator light 7 is turned on again, showing that the power cord is in a normal operating state.

In the above embodiment, the reset temperature of the temperature control switch 6 is 63±5° C.

In the above embodiment, the action temperature of the temperature control switch 6 is 78±3° C.

The present invention also discloses a temperature control power cord with a power-off indication circuit, which comprises a shell 1, a power output cord 2, a null wire pin 3 that is arranged on one side of the shell 1, and is electrically connected with the power output cord 2, a live wire pin 4 and a ground wire pin 5, wherein a temperature control switch 6 is connected to the live wire pin 4 in series, and a power-off indication control circuit board 8 is connected between the live wire pin 4 and the null wire pin 3 in parallel. A diode rectification filter module is arranged on the power-off indication control circuit board 8, and an indicator light 7 that is electrically connected with the diode rectification filter module is arranged on the power-off indication control circuit board 8.

The operating principle of the temperature control power cord with a power-off indication circuit is the following:

The power cord is electrically connected with a power-consuming equipment. The temperature control switch 6 can monitor the temperature in the shell 1, thereby exerting control by switching on/off the power-consuming equipment. When the temperature in the shell 1 is lower than the action temperature of the temperature control switch 6, the temperature control switch 6 is switched-on, and the electric connection between the live wire pin 4 and the power output cord 2 is achieved. Thus, the power cord normally supplies power to the power-consuming equipment. At this point, the power-off indication control circuit board 8 is switched off, and the indicator light 7 is turned off. The user can learn that the power cord is in a normal operating state from the off state of the indicator light 7. When excessive current is caused by the poor contact or overload of the plug, the temperature in the shell 1 can reach the action temperature of the temperature control switch 6. At this point, the temperature control switch 6 is automatically switched-off, the live wire pin 4 and the power output cord 2 are disconnected, and the power cord stops supplying power to the power-consuming equipment. When the power supply of the power cord is cut off, the diode rectification filter module rectifies and converts the current into pulsating direct voltage, and the indicating lamp 7 is in a flash state. Thus, the user can learn that the power supply of the power cord is cut-off from the flash state of the indicator light 7, thereby checking the electric connection between the power cord and the power-consuming equipment in time. When the temperature in the shell 1 is decreased lower than the reset temperature of the temperature control switch 6, the temperature control switch 6 is switch-on again, and the power cord starts to supply power to the power-consuming equipment. At the moment, the power-off indication control circuit board 8 is in an off state, and the indicator light 7 is turned off again, showing that the power supply of the power cord is restored.

In the above embodiment, the reset temperature of the temperature control switch 6 is 63±5° C.

In the above embodiment, the action temperature of the temperature control switch 6 is 78±3° C.

The present invention also discloses a temperature control power cord connected with a load power source, which comprises a shell 1, a power output cord 2, a null wire pin 3 that is arranged on one side of the shell 1, and is electrically connected with the power output cord 2, a live wire pin 4 and a ground wire pin 5, wherein a temperature control switch 6 is connected to the live wire pin 4 in series, and the output end of the power output cord 2 is electrically connected with a load power source 9. The load power source 9 comprises a power input end 90, and a power-off alarm circuit 10 that is connected with the power input end 90 in parallel. The power-off alarm circuit 10 is electrically connected with a battery 11 that is arranged on the load power source 9, and a buzzer 12 is arranged on the power-off alarm circuit 10.

The operating principle of the temperature control power cord connected with a power source is the following: The power cord is electrically connected with a power-consuming equipment.

The temperature control switch 6 can monitor the temperature in the shell 1, thereby exerting control by switching on/off the power-consuming equipment. When the temperature in the shell 1 is lower than the action temperature of the temperature control switch 6, the temperature control switch 6 is switched-on, and the electric connection between the live wire pin 4 and the power output cord 2 is achieved. Thus, the power cord normally supplies power to the power-consuming equipment. At this point, the power-off alarm circuit 10 is cut off, and the buzzer 12 does not work. When excessive current is caused by the poor contact or overload of the plug, the temperature in the shell 1 can reach the action temperature of the temperature control switch 6. At this point, the temperature control switch 6 is automatically switched-off, the live wire pin 4 and the power output cord 2 are disconnected, and the power cord stops supplying power to the power-consuming equipment. At the moment, the power-off alarm circuit 10 is connected with the battery 11 and enters a working state, and the buzzer 12 sounds an alarm under the control of the power-off alarm circuit 10, reminding the user that the power supply of the power cord is cut off. Thus, the user can check the electric connection between the power cord and the power-consuming equipment in time. When the temperature in the shell 1 is decreased lower than the reset temperature of the temperature control switch 6, the temperature control switch 6 is switch-on again, and the power cord starts to supply power to the power-consuming equipment. The power-off alarm circuit 10 is switched-off, and the buzzer 12 does not work.

In the above embodiment, the reset temperature of the temperature control switch 6 is 63±5° C.

In the above embodiment, the action temperature of the temperature control switch 6 is 78±3° C.

The description of above embodiments allows those skilled in the at to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A temperature control power cord with a normally-on indicator light, comprising:

a shell, a power output cord, a null wire pin that is arranged on one side of the shell, and is electrically connected with the power output cord, a live wire pin, and a ground wire pin, wherein a normally-on temperature control switch is connected to the live wire pin in series, and an indicator light is connected between the live wire pin and the null wire pin in parallel;

whereby said normally-on indicator light is powered on while said temperature control switch is powered on.

2. The temperature control power cord with the normally-on indicator light of claim 1, wherein a reset temperature of the temperature control switch is 63±5° C.

3. The temperature control power cord with the normally-on indicator light of claim 1, wherein an action temperature of the temperature control switch is 78±3° C.

4. A temperature control power cord with a power-off indication circuit, comprising: a shell, a power output cord, a null wire pin that is arranged on one side of the shell, and is electrically connected with the power output cord, a live wire pin, and a ground wire pin, wherein a temperature control switch is connected to the live wire pin in series, and a power-off indication control circuit board is connected between the live wire pin and the null wire pin in parallel, wherein a diode rectification filter module is arranged on the power-off indication control circuit board, and an indicator light that is electrically connected with the diode rectification filter module is arranged on the power-off indication control circuit board.

5. The temperature control power cord with the power-off indication circuit of claim 4, wherein a reset temperature of the temperature control switch is 63±5° C.

6. The temperature control power cord with the power-off indication circuit of claim 4, wherein an action temperature of the temperature control switch is 78±3° C.

7. A temperature control power cord connected with a load power source, comprising:

a shell, a power output cord, a null wire pin that is arranged on one side of the shell, and is electrically connected with the power output cord, a live wire pin, and a ground wire pin, wherein a temperature control switch is connected to the live wire pin in series, and an output end of the power output cord is electrically connected with a load power source, wherein the load power source comprises a power input end, and a power-off alarm circuit that is connected with a power input end in parallel, wherein the power-off alarm circuit is electrically connected with a battery that is arranged on the load power source, and a buzzer is arranged on the power-off alarm circuit;

wherein said load power source activates said buzzer when said power-off alarm circuit is activated to cut power to said power output cord.

8. The temperature control power cord connected with a load power source of claim 7, wherein a reset temperature of the temperature control switch is 63±5° C.

9. The temperature control power cord connected with a load power source of claim 7, wherein an action temperature of the temperature control switch is 78±3° C.

* * * * *